US009340040B2

(12) United States Patent
Veis

(10) Patent No.: US 9,340,040 B2
(45) Date of Patent: May 17, 2016

(54) LED ILLUMINATON SOURCE

(75) Inventor: Alex Veis, Netanya (IL)

(73) Assignee: Hewlett-Packard Industrial Printing, LTD, Netanya (IL)

( * ) Notice: Subject to any disclaimer, the term of this patent is extended or adjusted under 35 U.S.C. 154(b) by 0 days.

(21) Appl. No.: 14/411,048

(22) PCT Filed: Jul. 12, 2012

(86) PCT No.: PCT/IL2012/050244

§ 371 (c)(1),
(2), (4) Date: Dec. 23, 2014

(87) PCT Pub. No.: WO2014/009939

PCT Pub. Date: Jan. 16, 2014

(65) Prior Publication Data

US 2015/0191030 A1 Jul. 9, 2015

(51) Int. Cl.

| | |
|---|---|
| ***B41J 11/00*** | (2006.01) |
| ***F21V 29/50*** | (2015.01) |
| ***F21K 99/00*** | (2016.01) |
| ***H05B 33/08*** | (2006.01) |
| *F21Y 101/00* | (2016.01) |

(52) U.S. Cl.

CPC ..... *B41J 11/0015* (2013.01); *B41J 11/002* (2013.01); *F21K 9/30* (2013.01); *F21V 29/50* (2015.01); *H05B 33/0851* (2013.01); *F21Y 2101/00* (2013.01)

(58) Field of Classification Search

CPC ..... B41J 11/0015; B41J 11/002; F21K 9/30; F21V 29/50; F21Y 2101/00; H05B 33/0851

USPC ..... 347/102; 362/249.03

See application file for complete search history.

(56) References Cited

U.S. PATENT DOCUMENTS

| | | | | |
|---|---|---|---|---|
| 7,071,493 | B2 | 7/2006 | Owen et al. | |
| 7,659,547 | B2 | 2/2010 | Braddell et al. | |
| 7,794,074 | B2 | 9/2010 | Vosahlo et al. | |
| 2004/0262472 | A1 | 12/2004 | Thomas | |
| 2006/0204670 | A1 * | 9/2006 | Siegel | 427/487 |
| 2008/0244944 | A1 | 10/2008 | Nall et al. | |
| 2008/0315778 | A1 * | 12/2008 | Tatsukawa | 315/193 |
| 2009/0310338 | A1 | 12/2009 | Negley | |
| 2009/0316223 | A1 | 12/2009 | Takeuchi | |
| 2012/0097996 | A1 | 4/2012 | Lee et al. | |
| 2012/0305946 | A1 * | 12/2012 | Kuk et al. | 257/80 |

OTHER PUBLICATIONS

International Search Report and Written Opinion dated Apr. 12, 2013, issued on PCT Patent Application No. PCT/IL2012/050244 dated Jul. 12, 2012, European Patent Office.

Schneider et al., High Power UV-LED-clusters on Ceramic Substrates, Jun. 1-4, 2010, 2010 Electronic Components and Technology Conference., Karlsruhe, Germany.

* cited by examiner

*Primary Examiner* — Manish S Shah
*Assistant Examiner* — Roger W Pisha, II
(74) *Attorney, Agent, or Firm* — HP Inc Patent Department

(57) ABSTRACT

A LED illumination source may include one or a plurality of LED illumination modules, each LED illumination module comprising a plurality of LED clusters, wherein each LED cluster comprises a LED array which is rotated by an angle of rotation with respect to an axis which is parallel to a predefined direction of sweep.

15 Claims, 7 Drawing Sheets

LED ILLUMINATON SOURCE

CLAIM FOR PRIORITY

The present application is a national stage filing under 35 U.S.C 371 of PCT application number PCT/IL2012/050244, having an international filing date of Jul. 12, 2012, the disclosure of which is hereby incorporated by reference in its entirety.

BACKGROUND

Image forming systems, such as, for example, inkjet printers, include ink applicator units to form images on a substrate. Ink applicator units, such as inkjet printheads, eject liquid ink droplets onto the substrate. Ink curing devices may be used to cure the liquid ink deposited on the substrate to increase image quality of the images formed therewith and to facilitate printed image handling. Ink curing devices are designed to provide a uniform curing power distribution and sufficient curing power to cure on-line the printed image.

BRIEF DESCRIPTION OF THE DRAWINGS

Examples are described in the following detailed description and illustrated in the accompanying drawings in which.

DETAILED DESCRIPTION

Although examples are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. Unless explicitly stated, the method examples described herein are not constrained to a particular order or sequence. Additionally, some of the described method examples or elements thereof can occur or be performed at the same point in time.

Unless specifically stated otherwise, as apparent from the following discussions, it is appreciated that throughout the specification, discussions utilizing terms such as "adding", "associating" "selecting," "evaluating," "processing," "computing," "calculating," "determining," "designating," "allocating" or the like, refer to the actions and/or processes of a computer, computer processor or computing system, or similar electronic computing device, that manipulate, execute and/or transform data represented as physical, such as electronic, quantities within the computing system's registers and/or memories into other data similarly represented as physical quantities within the computing system's memories, registers or other such information storage, transmission or display devices.

The word "Cluster" in the context of the present specification is understood to mean an array or matrix of a number of LEDs e.g., 7×7 LEDs, as depicted in the figures, or any matrix of n×n or n×m LEDs, n and m being integers, or a similar arrangement.

The word "module" in the context of the present specification is understood to mean an assembly of a plurality of clusters, for example, five, seven, or ten clusters.

The word "source" in the context of the present specification is understood to mean an assembly of a plurality of modules, for example, five, seven or fifteen modules.

Figure 1:
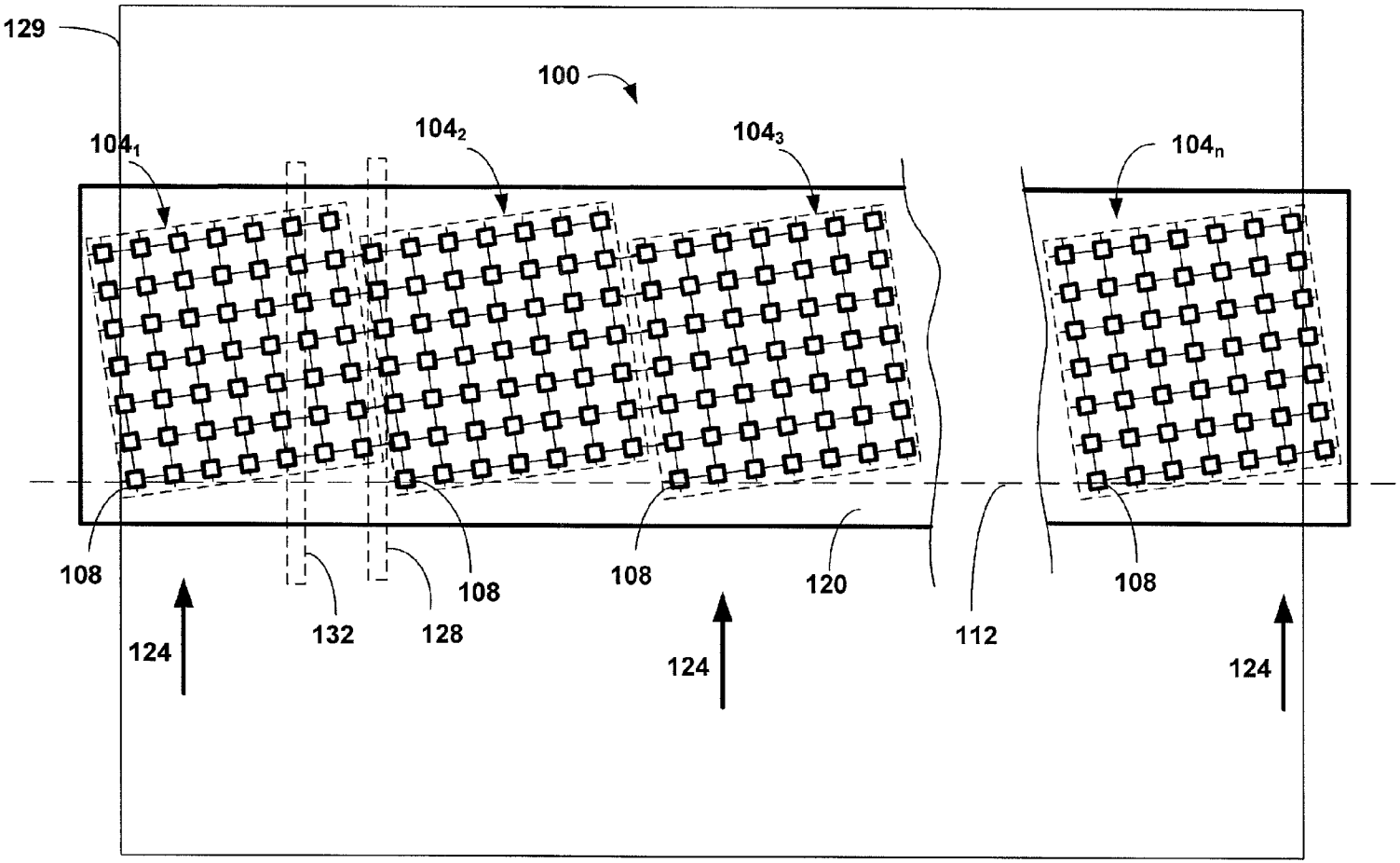
FIG. 1 illustrates a Light Emitting Diode (LED) illumination module, according to an example.

FIG. 1 illustrates a LED illumination module 100, according to an example.

LED illumination module 100 may be, for example, an ultra-violet (UV) radiation LED illumination module used for UV curing of ink, incorporated in an inkjet printer. While the LED illumination module is described herein in connection with inkjet printing and ink curing, it is to be clear that a LED illumination module, in accordance with examples, may be used for other illumination purposes, and in connection with other devices or independently.

LED illumination module 100 defines an illumination block which is designed to extend across a substrate 129 on which ink printing takes place (hereinafter—printed substrate). According to examples, the LED illumination module 100 is incorporated in an inkjet printer and is installed directly behind a printing assembly of one or a plurality of printheads, such that soon after the printing assembly dispenses ink onto a portion of the printed substrate 129 that portion is subjected to UV radiation from the LED illumination module 100. Typically this is facilitated by moving the printed substrate 129 with respect to the printing assembly, or moving the printing assembly with respect to the printed substrate in the general direction of sweep indicated by arrows 124.

LED illumination module 100 may comprise a plurality of two-dimensional clusters 104 (104$_1$, 104$_2$, 104$_3$ up to 104$_n$, n being an integer) of radiation emitting elements 108 (e.g., LEDs) arranged on board 120. Each cluster 104 may comprise a matrix of LEDs, arranged in an array of rows/columns and rotated about an angle with respect to the direction of sweep 124. Accordingly LED clusters 104 are rotated by a complementary rotation angle (complements the angle of rotation to 90 degrees) with respect to axis 112. Axis 112 may be an imaginary straight line which is substantially perpendicular to the direction of sweep 124. Axis 112 typically coincides with corresponding positions (e.g. corresponding LED elements) of clusters 104, such as, for example, the lowermost left LED elements of each cluster 104 (the ones specifically marked by 108), as depicted in this figure.

Radiation emitting elements 108 could be for example UV Light LEDs. Clusters 104 could be mounted on a common substrate (e.g. board 120) that could include electric conductors to provide electric power to each LED 108 of the LED clusters 104. Board 120 may also include installations to facilitate cooling (e.g. include cooling pipes in which coolant fluid may be passed adjacent the LEDS to dissipate heat generated by the LEDs), and to provide other functions to facilitate normal functioning of the radiation emitting elements 108. In some examples substrate 120 could be a metal substrate with proper heat conducting properties.

Rotation of each of the LED clusters, in an angle with respect to axis 112 is designed to facilitate a more even distribution of illumination across a portion of the printed substrate 129 to be illuminated. Had the clusters not been rotated columns of LEDs 108 of clusters 104 would be arranged in parallel to direction of sweep 124. In such a case strips of the printed substrate 129 directly underneath LED columns would receive more illumination than intermediary strips of the printed substrate 129 which are located underneath the gaps between LED columns, resulting in uneven distribution of illumination.

In order to facilitate a more uniform illumination each of the LED clusters is rotated about an angle with respect to axis 112, so that as the printed substrate 129 moves with respect to LED illumination module 100 (or vice versa), no strips of low illumination are present.

A proper angle of rotation may be determined with reference to the size of the LED clusters and the number of LEDs in each row/column. For many purposes the angle of rotation would be in the range of 5-20 degrees, but other ranges may also be considered.

For efficient wiring and simplicity purposes the angle of rotation of the LED clusters may be chosen so that rows of adjacent LED clusters are kept aligned. In the examples shown in the figures accompanying the present specification an external row of LEDs of one LED cluster is aligned with the second row of LEDs of the adjacent LED cluster. In some other examples, an external row of LEDs of a LED cluster may be aligned with any other internal row of an adjacent LED cluster.

However, this rotated arrangement of the LED clusters 104 could lead to a condition under which strips of the printed substrate 129 receive direct UV radiation from less LEDs as compared to other strips that receive direct UV radiation from more LEDs. This condition exists at the border zone between two neighboring LED clusters. As seen in FIG. 1, strip 128 at the border zone between LED cluster $\mathbf{104}_1$ and LED cluster $\mathbf{104}_2$ is directly covered by 6 LEDS, whereas strip 132 is directly covered by 7 LEDs.

Figure 2:
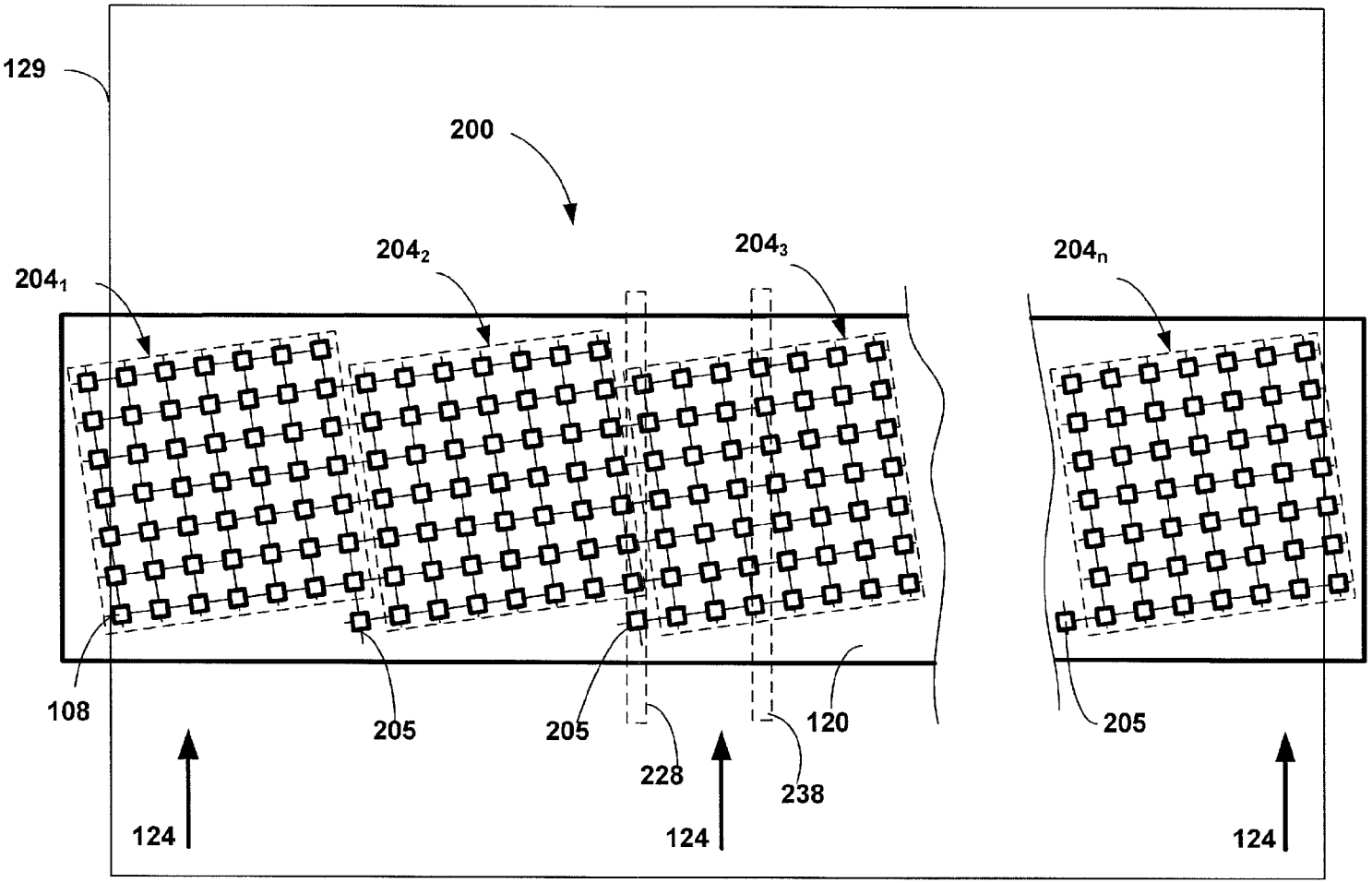
FIG. 2 illustrates a LED illumination module, according to another example.

Thus, FIG. 2 illustrates a slightly modified arrangement of the LED clusters of a LED illumination module, according to an example, which addresses the reduced illumination at border zone between rotated LED clusters. LED illumination module 200 may comprise a plurality of two-dimensional clusters 204 ($\mathbf{204}_1$, $\mathbf{204}_2$, $\mathbf{204}_3$ up to $\mathbf{204}_n$, n being an integer) of radiation emitting elements 108.

In order to enhance illumination in border zones between adjacent rotated LED clusters an additional LED 205 may be added. The additional LED 205 may be placed at a crossing point of a straight line aligned with a last column of one of the adjacent LED clusters and a straight line aligned with a last row of another LED cluster of the adjacent LED clusters.

In some examples, the last column of one LED cluster and the last row of the adjacent LED cluster are substantially perpendicular.

Thus strip 228, which is located on printed substrate 129 underneath the border zone between LED cluster $\mathbf{204}_2$ and LED cluster $\mathbf{204}_3$ is directly illuminated by 7 LEDs, just like intermediary strip 238, located on the printed substrate 129 underneath LED cluster $\mathbf{204}_3$.

Figure 3B:
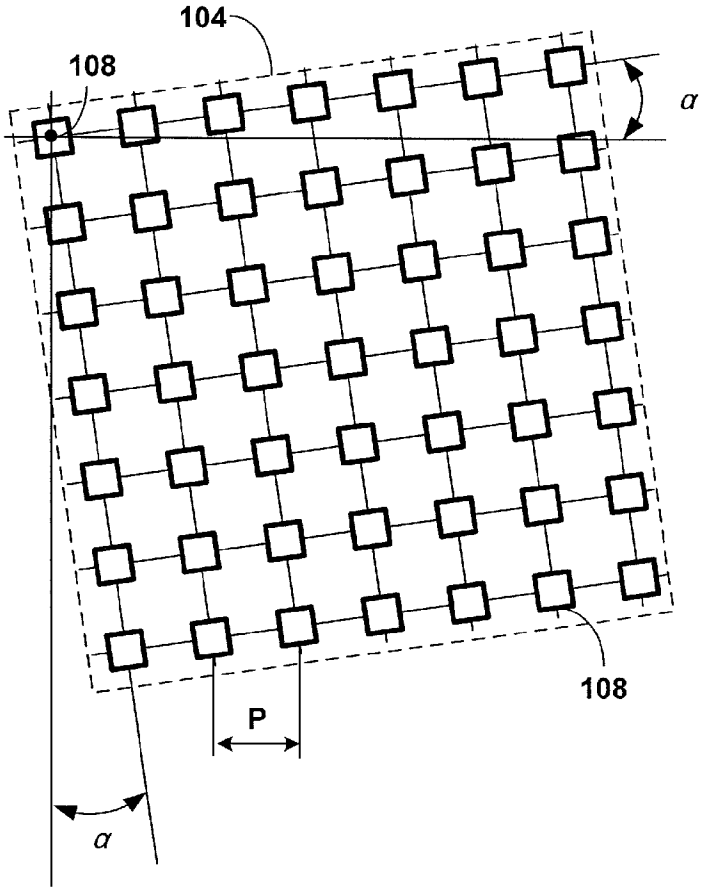
FIG. 3B shows LED cluster 104 in its rotated state.
Figure 3A:
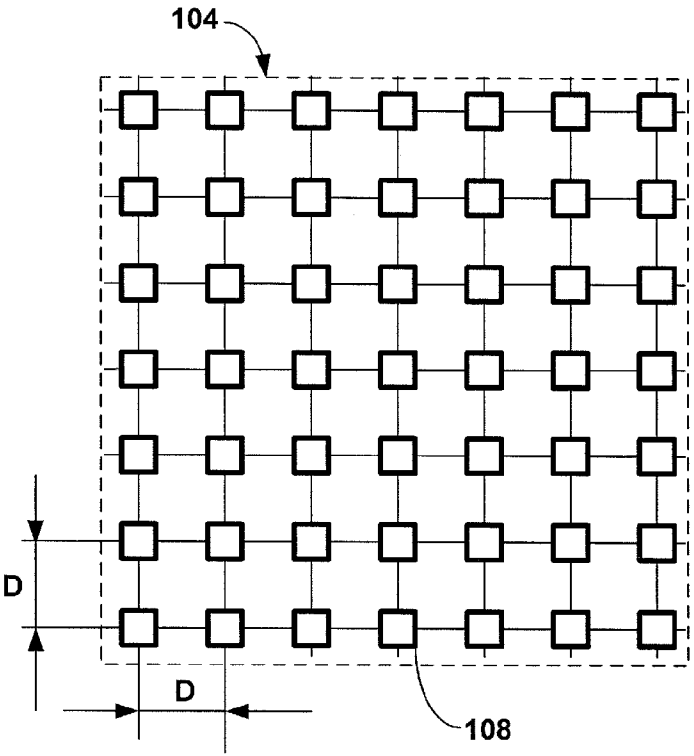
FIG. 3A is a schematic view illustrating a single LED cluster 104 of the LED illumination module 100 shown in FIG. 1 according to an example.

FIG. 3A is a schematic view illustrating a single LED cluster 104 of the LED illumination module 100 shown in FIG. 1 according to an example. FIG. 3B shows LED cluster 104 in its rotated state. This particular LED cluster 104 comprises a matrix of 7×7 LEDs, although a LED cluster according to other examples could comprise smaller number of LEDs (e.g. 3×3 LEDs) or a larger number of LEDs (e.g. 10×10 LEDs). The pitch D between the neighboring LED rows or columns of LEDs could be, in some examples, equal in both directions. A number of clusters 104 could be combined into modules assembly of a number of which would facilitate forming a UV radiation source of a desired length.

Rotation angle α (FIG. 3B) of the cluster may be selected so as to provide a uniform distribution of illumination over the surface of the printed image to be illuminated and to minimize UV power loss due to malfunction of one of cluster 104 LEDs 108 (or a row/column of LEDs).

For example, for a cluster of 7×7 LEDs, angle α may be selected so that $$\tan(\alpha) = \frac{1}{k},$$

where k is the number of LEDs in a row of the LED cluster 7 in this example), and angle α is 8.1301 degrees. Similarly, for a cluster of 5×5 LEDs angle α could be selected to be 11.3099 degrees, and for a cluster of 10×10 LEDs angle α could be selected to be 5.7106 degrees. Generally, the more LEDs in a row in a rotated LED cluster the smaller the angle of rotation is selected.

LEDs 108 could be dies with spacing between them of, for example, 2-6 mm (e.g. D=4 mm). The effective pitch after rotation P would then be P=D cos α and would be equal to 3.9598 mm, for D=4 mm.

Figure 4:
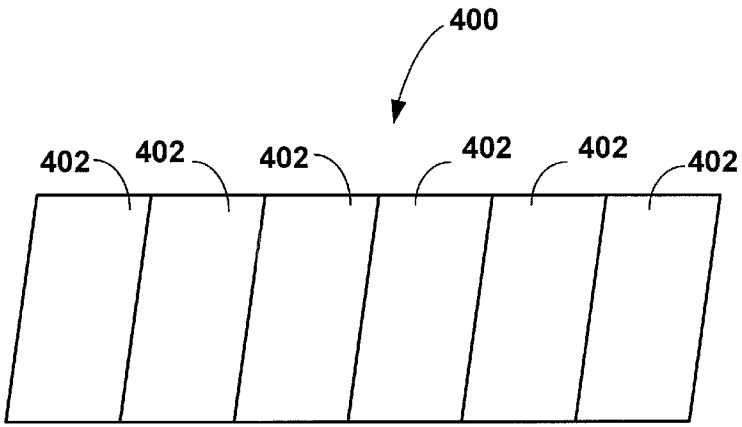
FIG. 4 is a schematic illustration of an illumination source assembled of a number of LED modules according to an example.

FIG. 4 is a schematic illustration of an illumination source 400 assembled of a number of LED modules 402 according to an example. Illumination source 000 in this example has an elongated aspect and includes six LED modules 402.

According to examples, LED illumination source 400 may generally exceed the dimension of the media support surface on which the printed substrate is to be supported. This is to eliminate the effect of reduced illumination at the margins of the LED illumination source 400. Typically, a margin (e.g. 10-30 mm on both sides of the LED illumination source 400) would not be suitable for illumination and thus the margins could be used for placing light measuring detectors (not shown) for intensity monitoring.

Typically illumination source 400 would consumes a few (e.g. 1.4) KW of power. A certain percentage of this power dissipates as heat and heats the substrate and the LEDs. Increase in operation temperature could adversely affect the operation of LED illumination source 400.

Figure 5:
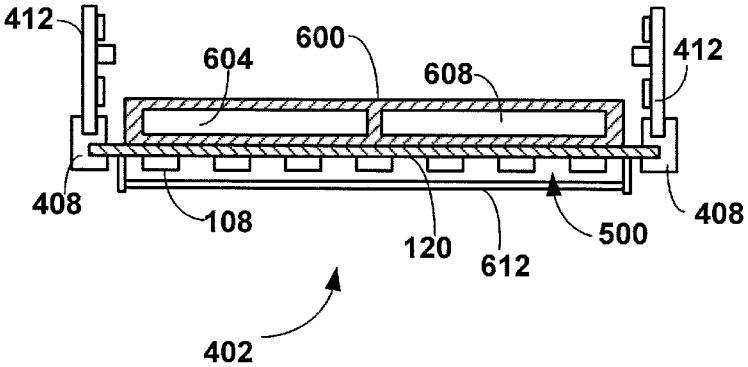
FIG. 5 illustrates a cross sectional view of an illumination LED module according to an example.

FIG. 5 illustrates a cross sectional view of an illumination LED module 402 according to an example. Each LED module 402 may be electrically connected via two right angle edge connectors 408 to driver boards 412 on either sides of LED module 402. LEDs 108 may be embedded in board 120.

A cooling panel 600 including one or a plurality of fluid coolant channels 604, 608 may be provided juxtaposed to LED board 120 which carrying the LED clusters to facilitate the circulation of fluid coolant to cool LED illumination module 402.

A pump (not shown) could be used to supply the fluid coolant in an amount and flow that would maintain a desired temperature at the LED board 120. According to examples, the fluid coolant could be selected from the group of fluids that includes, for example, air, water, ethanol, or other widely used fluid coolants. In most cases the desired LED dies operating temperature ranges between 15 to 25 degrees C. A protective cover 612, which is transparent to the spectral range of the radiation emitted by the LEDs (e.g. UV), may be mounted to protect LEDs 104 from dust, ink mist and paper residuals. For example, such cover 612 could be made from quartz.

Driver boards 412 could communicate with a host computer (not shown) that for example, controls printer operation via a bidirectional link. Host computer could be programmed or have appropriate hardware controlling operation of the driver boards. The bidirectional link could support a read back of LED light intensity and LED strings currents.

Figure 6:
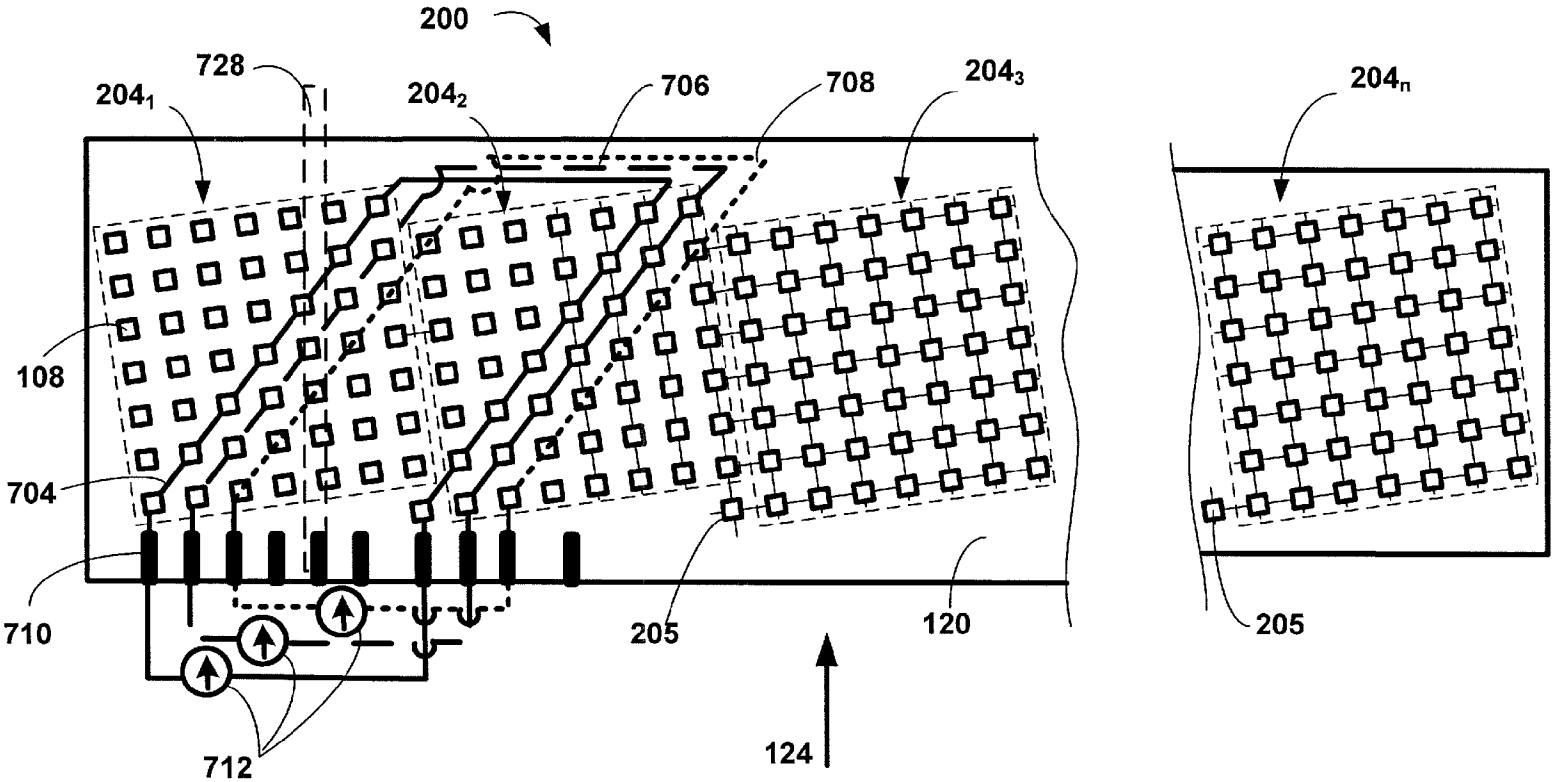
FIG. 6 is a schematic illustration of electrical connections of a LED illumination module (as shown in FIG. 2), according to an example.

FIG. 6 is a schematic illustration of electrical connections of a LED illumination module (as shown in FIG. 2), according to an example. The electrical connection of the LED dies is directed to increase redundancy of each of the LED clusters and LED dies rows.

In principle in order to eliminate or greatly reduce illumination failures each LED could be separately wired and powered by a power source. However this is a rather impractical solution, as it would involve numerous current sources and lengthy wirings.

In practice groups of LEDs in LED clusters are wired in series and connected to current sources (hereinafter—current chains).

A LED may malfunction resulting either in a short-cut in the current chain, in which case that LED would tops illuminating but the other LEDs in that current chain would still be able to illuminate, or in a disconnection, in which case all LEDs in that current chain would no longer illuminate. Malfunction of the latter kind could cause substantial reduction in illumination along the broken current chain.

Thus, in accordance with some examples, it is proposed to arrange the current chains of a LED illumination module in such a manner that the LEDs of each current chain are aligned substantially diagonally with respect to the direction of sweep 124 of the LED illumination module with respect to the printed substrate (not shown). "Diagonal" in the context of the present specification means that LEDs in a current chain are connected in series along a line which is substantially diagonal (e.g. in some examples at an angle of more than 5 degrees, in some other examples at an angle more than 10 degrees, in yet other examples at an angle of more than 20 degrees, in some other examples at an angle of more than 30 degrees, and in other examples at an angle of more than 40 degrees) with respect to the direction of sweep 124 of the illumination module by an angle which is substantially greater than the zero. In the case of rotated LED clusters "diagonal" refers to aligning the LEDs in a current chain along a line which defines an angle substantially greater than the angle of rotation of the LED clusters. In the example shown in FIG. 6 the current chains connect lines of LEDs which are diagonal both to the rows and columns of the rotated clusters.

Three LED current chains 704, 706, and 708 are shown in FIG. 6 (for brevity and simplicity). Current chains 704, 706, and 708 (shown as continuous line, dashed line and dotted line, respectively) are connected to one or more current sources 712, via contacts 710. The connection lines of each of the current chains 704, 706, and 708 are diagonal to the rows or columns of each of LED clusters 204 ($\mathbf{204}_1$, $\mathbf{204}_2$, $\mathbf{204}_3$ up to $204_n$, n being an integer). In current chain 704 the first LED in the first column of LED cluster $\mathbf{204}_1$ is linked to the second LED in the second column of LED cluster $\mathbf{204}_1$, which itself is linked to the third LED in the third column of LED cluster $\mathbf{204}_1$ and so on, up to the last LED in the last column of LED cluster $\mathbf{204}_1$. Then the current chain crosses over to the last LED in the last column of LED cluster $\mathbf{204}_2$, linking that LED to the one but last LED of the adjacent column of that LED cluster and so on until it reaches the first LED of the first column of LED cluster $\mathbf{204}_2$.

Various other diagonal current chain arrangements are possible.

Electrically connecting LED current chains in diagonal arrangements seem beneficial. In case where one of LEDs 108 along strip 728 becomes non-operative, it affects only about 14% of the UV radiation power directly irradiating strip 728.

A failure of a chain of LEDs could be compensated by proper control and operation of other power supplies/current sources.

Figure 7:
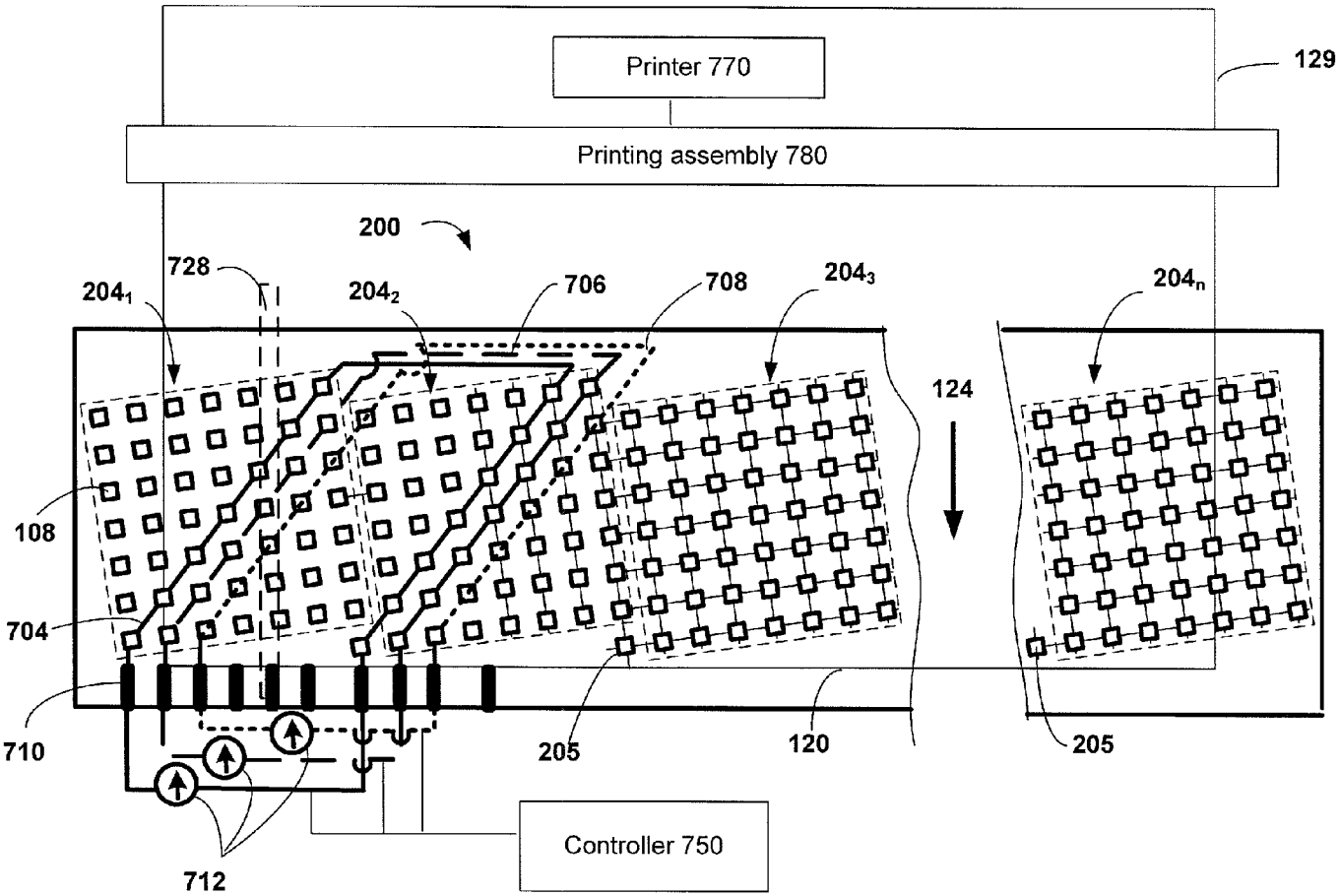
FIG. 7 illustrates an inkjet printer with an incorporated LED illumination system for ink curing, according to an example.

FIG. 7 illustrates an inkjet printer 770 with an incorporated LED illumination system 760 for ink curing, according to an example. LED illumination system includes LED illumination module 200 and controller 750.

Printer 770 is an inkjet printer which is designed to print on a substrate 129 using curable ink. Printer 770 may include printing assembly 780 (e.g. one or a plurality of printheads) which is used to deposit droplets of ink in a predetermined pattern on the printed substrate 129.

LED illumination module 200 is designed to generate curing UV radiation onto the printed substrate 129, after the ink pattern is deposited onto the printed substrate 129.

Controller 750 is electrically connected to LED current chains 704, 706 and 708, and is designed to monitor the current chains and sense current changes indicative of malfunctioning LEDs in current chains.

In accordance with some examples, if a LED current chain is broken (due to a malfunctioning LED that causes an electrical disconnection), controller 750 would increase the current in neighboring LED current chains to compensate for the loss of illumination attributed to the shut-down LED current chain.

According to some examples, in the case of a short-cut LED, controller 750 would increase the current in the related LED current chain to address the added resistance.

The following parameters and measures are given as an example of a LED illumination source. It is to be understood that other parameters and measures could be considered, according to other examples.

An exemplary LED illumination source could comprise a plurality of LED illumination modules, each having a plurality of LED clusters. A typical LED die Size: 1 mm×1 mm, center-to-center distance between the LED dies: 4 mm, The LED illumination source could have a usable length of 1624 mm curing area with about 20 mm of unused margins on both sides of the source.

According to examples, an inkjet printer which prints using a curable ink may include a LED illumination source that includes one or a plurality of LED illumination modules each including one or a plurality of rotated LED clusters.

The printer may also include a mechanism to provide relative movement between the LED illumination source and the printed substrate in a predetermined direction during the printing and curing operation, and a controller to control printer operation.

A LED illumination source according to examples can facilitates a uniform UV radiation coverage over a large area. It involves a scalable architecture where LED illumination modules could be stacked to provide different UV illumination sources. Similarly, LED clusters may be stacked to provide different illumination modules.

Examples may be embodied in the form of a system, a method or a computer program product. Similarly, examples may be embodied as hardware, software or a combination of both. Examples may be embodied as a computer program product saved on one or more non-transitory computer readable medium (or mediums) in the form of computer readable program code embodied thereon. Such non-transitory computer readable medium may include instructions that when executed cause a processor to execute method steps in accordance with examples. In some examples the instructions stores on the computer readable medium may be in the form of an installed application and in the form of an installation package.

Such instructions may be for example loaded into one or more processors and executed.

For example, the computer readable medium may be a non-transitory computer readable storage medium. A non-transitory computer readable storage medium may be, for example, an electronic, optical, magnetic, electromagnetic, infrared, or semiconductor system, apparatus, or device, or any combination thereof.

Computer program code may be written in any suitable programming language. The program code may execute on a single computer, or on a plurality of computers.

Examples are described hereinabove with reference to flowcharts and/or block diagrams depicting methods, systems and computer program products according to examples.

What is claimed is:

1. An LED illumination source comprising:

one or a plurality of LED illumination modules, each LED illumination module comprising a plurality of LED clusters, wherein each LED cluster comprises an LED array which is rotated by an angle of rotation with respect to an axis which is parallel to a predefined direction of sweep, wherein the angle of rotation is selected such that $$\tan(\alpha) = \frac{1}{k},$$

where k is the number of LEDs in a row of any of the LED clusters, and α is the angle of rotation.

2. The LED illumination source of claim 1, wherein LED rows of different LED clusters of the plurality of LED clusters are aligned.

3. The LED illumination source of claim 1, wherein the LEDs comprise UV LEDs.

4. The LED illumination source of claim 1, further comprising a cooling panel juxtaposed to a board carrying said plurality of LED clusters to cool each of said one or a plurality of LED illumination modules.

5. The LED illumination source of claim 1, further provided with a protective cover, which is transparent to a spectral range of the radiation emitted by the LEDs.

6. The LED illumination source of claim 1, wherein groups of LEDs of the plurality of LED clusters are electrically linked in current chains, wherein LEDs in each of the groups of LEDs are electrically linked along a line which is diagonal to the direction of sweep at an angle which is greater than the angle of rotation of the LED clusters.

7. The LED illumination source of claim 1, wherein an additional LED is provided at a border zone between adjacent LED clusters of the plurality of clusters.

8. An LED illumination source comprising:

one or a plurality of LED illumination modules, each LED illumination module comprising a plurality of LED clusters, wherein each LED cluster comprises an LED array which is rotated by an angle of rotation with respect to an axis which is parallel to a predefined direction of sweep, wherein an additional LED is provided at a border zone between adjacent LED clusters of the plurality of clusters.

9. The LED illumination source of claim 8, wherein the additional LED is positioned at a crossing point of a straight line aligned with a last column of one of the adjacent LED clusters and a straight line aligned with a last row of another LED cluster of the adjacent LED clusters.

10. The LED illumination source of claim 8, wherein the angle of rotation is selected such that $$\tan(\alpha) = \frac{1}{k},$$

where k is the number of LEDs in a row of any of the LED clusters, and α is the angle of rotation.

11. The LED illumination source of claim 8, wherein groups of LEDs of the plurality of LED clusters are electrically linked in current chains, wherein LEDs in each of the groups of LEDs are electrically linked along a line which is diagonal to the direction of sweep at an angle which is greater than the angle of rotation of the LED clusters.

12. An LED illumination source comprising:

one or a plurality of LED illumination modules, each LED illumination module comprising a plurality of LED clusters, wherein each LED cluster comprises an LED array which is rotated by an angle of rotation with respect to an axis which is parallel to a predefined direction of sweep, wherein groups of LEDs of the plurality of LED clusters are electrically linked in current chains, wherein LEDs in each of the groups of LEDs are electrically linked along a line which is diagonal to the direction of sweep at an angle which is greater than the angle of rotation of the LED clusters.

13. The LED illumination source of claim 12, further comprising a controller to monitor electric currents in the current chains, and to adjust illumination power of LEDs in one or more of the current chains neighboring to a malfunctioning current chain of said current chains.

14. The LED illumination source of claim 12, wherein the angle of rotation is selected such that $$\tan(\alpha) = \frac{1}{k},$$

where k is the number of LEDs in a row of any of the LED clusters, and α is the angle of rotation.

15. The LED illumination source of claim 12, wherein an additional LED is provided at a border zone between adjacent LED clusters of the plurality of clusters.

* * * * *